United States Patent [19]

Drummond

[11] 4,003,111

[45] Jan. 18, 1977

[54] PROCESS FOR PREPARING A TEXTURIZED GLASS FIBER STRAND

[75] Inventor: Warren W. Drummond, Allison Park, Pa.

[73] Assignee: PPG Industries, Inc., Pittsburgh, Pa.

[22] Filed: Dec. 3, 1975

[21] Appl. No.: 637,345

[52] U.S. Cl. ..... 28/72.11; 28/72.12; 28/75 WT; 57/140 G; 57/157 F; 118/325

[51] Int. Cl.[2] ..... D02G 1/20; D02G 1/16

[58] Field of Search ..... 28/1.3, 1.4, 72.11, 28/72.12, 75 WT; 118/325; 57/77.3, 157 F, 164, 34 B, 140 G

[56] References Cited

UNITED STATES PATENTS

| | | | |
|---|---|---|---|
| 2,515,299 | 7/1950 | Foster et al. | 28/72.12 X |
| 3,022,566 | 2/1962 | Daniels et al. | 28/72.12 X |
| 3,317,296 | 5/1967 | Irwin et al. | 28/72.11 X |
| 3,398,220 | 8/1968 | Port et al. | 28/72.11 X |
| 3,672,947 | 6/1972 | Luscher et al. | 28/72.11 X |
| 3,763,526 | 10/1973 | Benson et al. | 28/1.4 |

*Primary Examiner*—Louis K. Rimrodt
*Attorney, Agent, or Firm*—John E. Curley

[57] ABSTRACT

A process is described for producing texturized textile yarns having improved characteristics and in which forming supply packages may be used as the feed yarn. The process has particular utility in the production of fiber glass yarns and produces yarns having a rounded appearance with good texture on the outer surfaces.

8 Claims, 6 Drawing Figures

FIG. 1
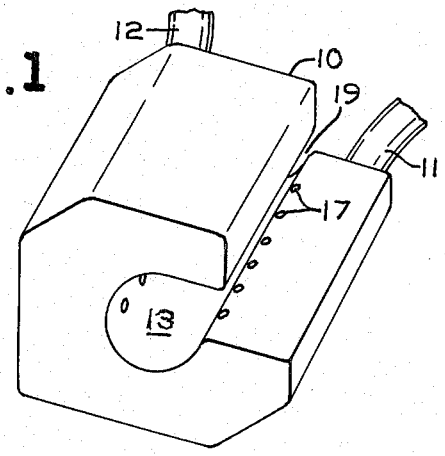
FIG. 2
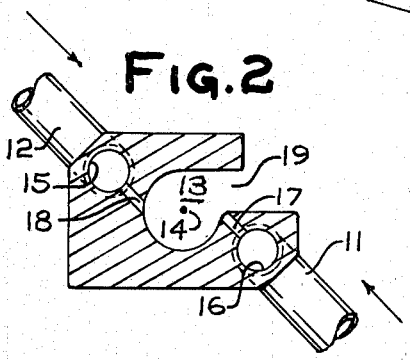
FIG. 3
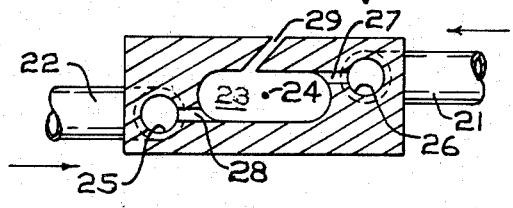
FIG. 5
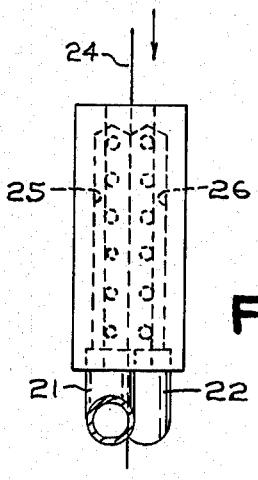
FIG. 4
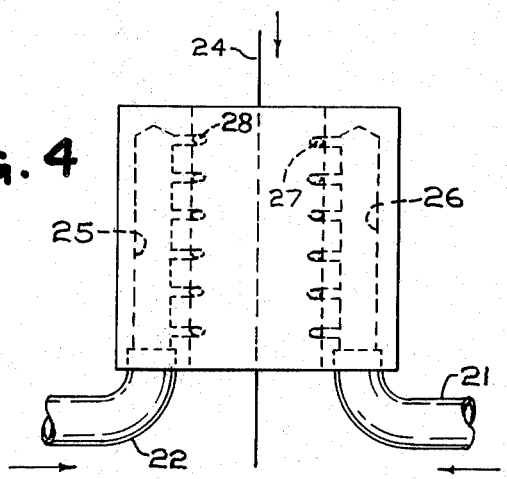
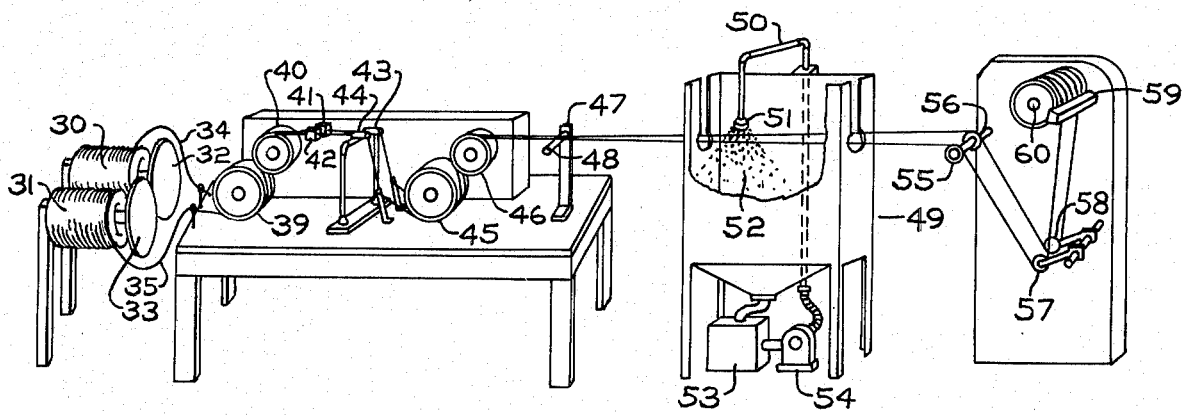
FIG. 6

PROCESS FOR PREPARING A TEXTURIZED GLASS FIBER STRAND

BACKGROUND OF THE INVENTION

In U.S. Pat. Nos. 3,672,947 and 3,730,137, assigned to the assignee of this invention and incorporated herein by reference, process and apparatus are disclosed to produce texturized yarns continuously. The yarns produced find utility in the textile industry where they are woven into cloth used for decorative fabrics or for industrial use in the reinforcement of resin articles.

In the prior art process the yarn, which is fed to the texturizing jets used to apply texture to the yarns by contacting the yarn with high pressure fluid, usually air, is fed from a bobbin source. Thus, for example with a fiber glass yarn, the yarn fed to the system has been produced in a glass forming operation in the conventional manner by first winding it onto a forming package. The forming package produced in this conventional manner is then dried in a drying oven to reduce the moisture content to usually below 0.5 percent by weight or less and the forming package is then transferred to a conventional textile twisting frame where the yarn is removed from the forming package while applying a twist to it to any desired degree and wound on a bobbin for subsequent use. The twisting of the strand accomplished during the twist frame operation tends to form the strand into a more round configuration than the flat appearance of strand normally encountered on a forming package. These bobbins are then suitable for use in the aforementioned process and apparatus of U.S. Pat. No. 3,672,947 and 3,730,137to produce a texturized yarn product. The rounded yarn is desired in the texturizing operation since the yarn must be threaded into the texturizing jets utilized in the texturizing process.

As will be readily understood by those skilled in the art, utilization of bobbin feed material requires considerable handling of the yarns after forming by requiring them to be twisted and placed upon a bobbin prior to use. These handling operations of course add considerably to the cost of the input yarn to the texturizing process and renders the yarns produced by the texturizing process of the prior art somewhat expensive since they have incurred considerable costs in production in their preparation as a feed material to this process.

THE PRESENT INVENTION

In accordance with the present invention a texturizing process is provided in which yarn from a forming package may be utilized directly in a texturizing operation. Thus, in accordance with the instant invention, yarn is removed from a dried forming package, passed through a fluid treating device which in its interior subjects the yarn to considerable agitation by circumferential whirling fluid. The whirling fluid acts to disturb the filaments within the strand and breaks any adherance between filaments that might exist. It also provides the yarn with a false twist between its exit from the fluid treating area and its entrance into the texturizing jets utilized to apply texture to the yarns.

For a more complete understanding of the present invention, reference is made to the accompanying drawings in which:

FIG. 1 is a perspective view of one embodiment of the instant invention having a slotted strand entry and two rows of fluid inlets.

FIG. 2 is a cross-section of FIG. 1 showing the internal air chamber and the fluid inlet communications therewith.

FIG. 3 is a cross-section of another embodiment of a slotted blower device having an elliptical central cavity with two rows of fluid inlets positioned therein.

FIG. 4 is a longitudinal front elevation of the blower of FIG. 3 showing the arrangement of fluid inlets and internal fluid chambers.

FIG. 5 is a side elevational view of the blower of FIG. 3 showing the arrangement of the feed inlets to the chambers inside of the blower and internal inlets to the central cavity of the blower of FIG. 3.

FIG. 6 is a diagrammatic illustration of utilization of the blower of FIGS. 1 and 2 utilized to produce a texturized strand in a texturizing operation.

Turning to the drawings, and to FIGS. 1 and 2 in particular, there is shown a blower 10 which is provided with a central bore or passageway 13 formed by the walls of the blower 10. An elongated slot 19 is provided to permit passage of strand 14 into the chamber 13 from the exterior of the blower 10. A plurality of fluid inlets 17 are positioned in a row on the lip of the blower 10 and the inlets 17 are machined to direct all fluid exiting from the inlets to the underside of the chamber 13 positioned above the inlet 17. A similar row of inlets 18 is provided at the back of the chamber 13 and the inlets are machined to direct fluid emanating from the inlets 18 against the surface of the back wall of chamber 13 towards the inlets 17 and in a path around the chamber surface which is perpendicular to the strand 14 passing longitudinally through the chamber 13. Inlets 17 are fed from a common header 16 located on the interior of the blower 10. Inlets 18 are fed from a common header or chamber 15 located on the interior of blower 10. These chambers 16 and 15 are typically provided by boring a hole along the longitudinal axis of the blower 10, boring holes 17 and 18 into the side of the chamber or header 16 and 15, respectively, and sealing one end of the chambers 16 and 15 by brazing a plug therein. An inlet for fluid is provided on the open end of each chamber 16 and 15 so that fluid inlets 11 and 12 can be connected thereto to provide for the feeding of fluid under pressure to the chambers 16 and 15, respectively. The strand 14 traveling through the device 10 is thus subjected to tangential contact with high velocity air as it travels through the blower. Typically, the central bore 13 of the blower 10 is of a diameter which is at least ten times the diameter of the strand passing through the bore.

FIGS. 3, 4 and 5 show another embodiment of the blowers utilized in the instant invention. In this embodiment the blower 20 is provided with an elliptical shaped central cavity 23. A longitudinal slot 29 is provided for the purpose of passing strand 24 into central cavity 23. Fluid inlet lines 21 and 22 are provided to introduce treating fluid into the chambers 25 and 26 which are located on the inside walls of the blower 20, at each end thereof. The chamber 25 is provided with a plurality of outlet passages 28 which are machined at their end which communicates with cavity 23 to direct fluid emanating from these passages along the interior wall of the cavity 23 toward the second set of inlets 27. The fluid passages 27 communicate with the fluid chamber 26 and are machined at their ends communicating with the chamber 13 to direct fluid along the wall of the chamber in a direction towards inlets 28. The fluid entering the chamber 13 from inlets 27 and 28 is thus directed in circumferential fashion around the wall of chamber 13.

In the operation of the instant process as shown in FIG. 6, the feed supply strands or yarns 34 and 35 were supplied to the process from forming packages 30 and 31. The forming packages 30 and 31 in the case of the treatment of fiber glass yarns are prepared by drawing molten glass from a molten glass source into a multiplicity of filaments in the conventional manner, applying a binder or size to the filaments, gathering the filaments into a strand and winding the strand at high speed on the surface of a winding machine which carries a forming package tube thereon. The forming packages resulting from this operation are normally dried to provide a forming package having a moisture content of less than 0.5 percent by weight. Forming packages having this weight percent of water or less thereon are thus utilized as the source of material for use in the process described in FIG. 6.

As shown in FIG. 6, the strands 34 and 35 are removed from the packages 30 and 31, respectively. The strands 34 and 35 pass over the exterior of the wheel devices 32 and 33, respectively so that the strand can be removed from the outside of the packages without any snagging. The strands 34 and 35 are then passed over the surface of a drive roll 39 coupled for rotation to a suitable drive source (not shown) and subsequently over a nip roller 40 journaled for rotation with its outer cylindrical surface in frictional contact with the outer cylindrical surface of a roll 39. Strands 34 and 35 are then passed from the surface of the nip roll 40 through blowers 41 and 42, respectively. Blowers 41 and 42 are preferably the blowers shown in FIGS. 1 and 2, but the blower of FIGS. 3, 4 and 5 may also be employed. Using the blowers of FIGS. 1 and 2 as blowers 41 and 42, air, the preferred fluid, is fed to these blowers through a suitable supply line (not shown) and the air is passed circumferentially around the interior cavity or channel running lengthwise of the blowers 41 and 42. The air is fed from a pressurized air source (not shown) at about 20 to about 80 pounds per square inch (1.406 to 5.624 kilograms per square centimeter) or more. The whirling air inside of the blowers 41 and 42 resulting from the air feed and its passage around the cavity of the blowers 41 and 42 through which strands 34 and 35 are passing tends to create in the strands a false twist leaving them in a more receptive state for the air texturizing that follows than that which is normally encountered by a twisted strand from a bobbin source being fed to a similar air texturizing system.

Strands 34 and 35 after emerging from the blowers 41 and 42 are passed through texturizing jets 43 and 44, respectively. These jets are standard jets used to texturize yarn surfaces and are described in detail in U.S. Pat. Nos. 2,783,609, 3,328,863 and 3,381,346, incorporated herein by reference. After being texturized, strands 34 and 35 are passed over the roll 45 which is coupled to a power source for rotation. The yarns 34 and 35 pass from roll 45 over the surface of nip roll 46 which is journaled for rotation with its outer cylindrical surface in frictional contact with the outer cylindrical surface of roll 45. Yarns 34 and 35 are then passed over guidebar 48 mounted on a bracket 47 and both yarns are passed under the binder sprayhead 51 which applies binder 52 to the strands. Binder 52 is pumped to the sprayhead 51 by a pump 54 through pipe 50 from a binder reservoir 153. Excess binder is collected continuously in reservoir 53 by a suitable drain arrangement in the bottom of the binder applicator zone.

The binder used can be any desired composition consistency and viscosity as long as it can be applied through the sprayhead 51. Thus, binders containing starches, oils, resin, hot melts or solvent type materials and the like including emulsions, suspensions, dilutions and the like can be utilized.

Strands 34 and 35 are passed to the winding operation after binder 52 is applied thereto by passing them over rolls 56 and 55, respectively. The strands are then passed over tension rolls 58 and 57 which coact with the motor (not shown) driving mandrel 60 to maintain constant tension on the strands 34 and 35 during winding and maintain a constant take-up winding speed of the strand. The strands 34 and 35 are wound in two packages on winder 60 which is equipped with a roller bail 59 to maintain the packages smooth on the surface and square ended. The texturizing and binder application of strand is more fully described in U.S. Pat. No. 3,730,137 and the winder 60 employed with the tension rolls 58 and 57 is the winder more fully described in U.S. Pat. No. 3,814,339, both of these patents being assigned to the assignee of this invention and incorporated herein by reference.

The texturized yarn produced in this embodiment using the blowers 41 and 42 in practicing the process are found to be round in shape similar to the yarns normally produced in practicing the process of U.S. Pat. No. 3,730,137. Texturizing is accomplished from a forming package yarn supply rather than the bobbin feed of that patent. This of course considerably reduces the cost of producing texturized yarns in accordance with prior art practices. The yarns after passing through the blowers 41 and 42 are at low tension and have a flase twist in them rendering them more receptive to the texturizing than the twisted yarns normally used from bobbin sources. The use of the blower devices 41 and 42 does not hinder the operation in any way and yarns 34 and 35 may be fed at rates of 500 to 1,000 yards (457.2 to 914.4 meters) per minute or higher in the same fashion as yarns are fed in the aforementioned U.S. Pat. No. 3,730,137.

The air supply system to the texturizing jets 43 and 44 utilized in practicing the instant invention are those conventionally used in the art. Thus, air pressures on the order of 20 to 80 pounds per square inch gauge (1.406 to 5.624 kilograms per square centimeter) are normally employed to provide texturizing to the yarns emanating from the blowers 41 and 42 and entering the texturizing jets 43 and 44. The fluids utilized in the turbulent zones of the blowers 41 and 42 in the process depicted in FIGS. 6 are typically gases such as air, nitrogen, oxygen, carbon dioxide and other similar gases in a typical glass strand fed thereto. In the preferred embodiment of the invention, air is utilized as the gas source. The operation described in FIG. 6 may also employ the blower of FIGS. 3, 4 and 5 to produce texturized yarns, but it is preferred that the central cavity of the blower has a more rounded than elliptical shape for most applications and for this reason the blowers of FIGS. 1 and 2 represent the preferred embodiment.

The zone of turbulence created by blowers 41 and 42 shown in FIG. 6 is usually of small diameter and the central cavity of the zone inside of these blowers is typically from ⅛ to ¾ inch (0.3175 to 1.91 centimeters) in diameter, preferably from ¼ to ½ inch (0.610 to 1.27 centimeters). Generally the blowers 41 and 42 are of a length sufficient to impart a false twist to the strand during its passage through the block and the central cavity of the blower. Lengths are from 1 to 6 inches (2.54 to 15.24 centimeters) are typical, with 1 to 3 inches (2.54 to 7.26 centimeters) being preferable for proper strand treatment.

Using high pressure air, as an example, for feed to the zone of turbulence through the rows of inlets arranged in vertical alignment around the wall of the cavities and with the small diameter of the cavity defining a small circumference over which the air travels, air revolves around the circumference of the cavity in the blowers at values of between 20,000 to 1,070,000 revolutions per minute. Usually with cavities of ¼ to ½ inch (0.610 to 1.27 centimeters) in diameter the zone of turbulence has air flowing around it at 150,000 to 310,000 revolutions per minute.

The treatment of yarns described herein in connection with the production of texturized yarns may be conducted on synthetic yarns other than glass. Thus, yarns such as nylon, rayon and other man-made fibers may be treated in this manner. It is also within the contemplation of the invention to subject natural fibers such as cotton to this treatment. Similarly, while the process has been described to a specific type of texturizing process, it is also contemplated that yarns fed to conventional core and overfeed texturizing processes be subjected to the activity of the fluid blowers prior to the texturizing step. In this manner the use of forming package feeds, especially in the case of glass yarns, can be realized to eliminate the more costly bobbin sources now employed.

While the invention has been described with reference to certain specific illustrated embodiments, it is not intended that it be so limited except insofar as appears in the accompanying claims.

I claim:

1. A process for preparing a texturized glass fiber containing strand comprising feeding a glass fiber strand from at least one forming package to a zone of fluid turbulence, passing the strand through said zone of fluid turbulence while passing fluid in said zone at high speed in a circumferential direction around the zone and perpendicular to the path of travel of the strand to thereby introduce a false twist into the strand, passing the strand having a false twist therein from said zone of turbulence into a texturizing zone, texturizing the strand having a false twist therein with a second fluid in said texturizing zone and collecting the resulting texturized glass fiber strand.

2. The method of claim 1 wherein the fluid employed is air in both of said zones.

3. The method of claim 1 wherein the fluid employed in both zones is a gaseous fluid.

4. The method of claim 1 wherein the strand leaving the texturizing zone is treated with a binder prior to being collected.

5. A method of preparing a texturized glass fiber strand comprising feeding a glass fiber strand from a forming package having less than 0.5 percent by weight moisture therein to a zone of fluid turbulence, passing the strand through said zone of fluid turbulence at a speed above about 500 feet (152.4 meters) per minute, introducing gaseous fluid into said zone of fluid turbulence and passing the fluid circumferentially around the interior of said zone at rates of 20,000 to 1,070,000 revolutions per minute continuously to thereby produce a false twist in said glass fiber strand, removing the glass fiber strand from said zone of fluid turbulence, passing the glass fiber strand from the zone of fluid turbulence into a fluid texturizing zone, contacting said glass fiber strand in the texturizing zone with a gaseous fluid introduced thereto at pressures of 20 to 80 pounds per square inch gauge (1.406 to 5.624 kilograms per square centimeter) to thereby bulk said glass fiber strand, removing the resulting bulked glass fiber strand from the texturizing zone and collecting said bulked strand.

6. The method of claim 5 wherein said gaseous fluid is air.

7. The method of claim 6 wherein the said bulked glass fiber strand has a binder applied thereto prior to being collected.

8. The method of claim 6 wherein the said bulked glass fiber strand has a binder applied thereto prior to being collected.

* * * * *